US011529813B2

(12) United States Patent
Sato et al.

(10) Patent No.: US 11,529,813 B2
(45) Date of Patent: Dec. 20, 2022

(54) PRESSURE ADJUSTMENT UNIT, LIQUID EJECTING HEAD, AND LIQUID EJECTING APPARATUS

(71) Applicant: SEIKO EPSON CORPORATION, Tokyo (JP)

(72) Inventors: Masahiko Sato, Matsumoto (JP); Yu Okamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 126 days.

(21) Appl. No.: 17/181,762

(22) Filed: Feb. 22, 2021

(65) Prior Publication Data

US 2021/0260887 A1 Aug. 26, 2021

(30) Foreign Application Priority Data

Feb. 25, 2020 (JP) ..... JP2020-029066

(51) Int. Cl.
*B41J 2/175* (2006.01)

(52) U.S. Cl.
CPC ..... *B41J 2/17596* (2013.01); *B41J 2202/05* (2013.01)

(58) Field of Classification Search
None
See application file for complete search history.

(56) References Cited

U.S. PATENT DOCUMENTS 8,602,520 B2 * 12/2013 Yokouchi ..... B41J 2/17596 347/29
8,708,467 B2 * 4/2014 Aruga ..... B41J 2/17506 347/85
8,967,776 B2 * 3/2015 Aruga ..... B41J 2/14 347/85
9,102,842 B2 * 8/2015 Shinoda ..... C09D 11/10
9,315,034 B2 * 4/2016 Ono ..... B41J 2/17596
9,476,507 B2 * 10/2016 Akahane ..... F16K 17/085
10,155,394 B2 * 12/2018 Okui ..... B29C 66/1122
10,207,513 B2 * 2/2019 Ishii ..... B41J 2/17596
10,399,353 B2 * 9/2019 Sato ..... B41J 2/17596
10,457,061 B2 * 10/2019 Sato ..... B41J 2/17556

(Continued)

FOREIGN PATENT DOCUMENTS

JP 2011-207189 10/2011
JP 2013-132895 7/2013

(Continued)

*Primary Examiner* — Umashankar Venkatesan
(74) *Attorney, Agent, or Firm* — Workman Nydegger

(57) ABSTRACT

A pressure adjustment unit includes a valve body including a base end portion, a shaft portion protruding in a first-direction from the base end portion, and an elastic member, and a casing that has a partition wall formed with a through hole into which the shaft portion is inserted, and a first-wall protruding in a second-direction opposite to the first-direction to define the first-chamber. On a first-chamber side of the partition wall, a valve seat, which is annular, is provided around the through hole to block a flow path by contacting with the elastic member, an outer periphery of the base end portion has a positioning region, and a distance between a first-direction-side end portion of the positioning region and a first-direction-side distal end of the shaft portion is shorter than a distance between the valve seat and a second-direction-side end portion of the first-wall.

14 Claims, 10 Drawing Sheets

(56) References Cited

U.S. PATENT DOCUMENTS

| | | | | |
|---|---|---|---|---|
| 10,458,552 | B2 * | 10/2019 | Ishida | B41J 2/17509 |
| 10,569,559 | B2 * | 2/2020 | Hanaoka | B41J 2/175 |
| 10,625,513 | B2 * | 4/2020 | Sato | B41J 2/14233 |
| 2009/0153630 | A1 * | 6/2009 | Ito | B41J 2/19 347/85 |
| 2010/0225718 | A1 * | 9/2010 | Uezawa | B41J 2/17596 347/93 |
| 2013/0161422 | A1 | 6/2013 | Miyajima et al. | |
| 2017/0057242 | A1 | 3/2017 | Ueda | |
| 2018/0333960 | A1 | 11/2018 | Sato et al. | |
| 2019/0105901 | A1 | 4/2019 | Ishida | |

FOREIGN PATENT DOCUMENTS

| | | |
|---|---|---|
| JP | 2016-132191 | 7/2016 |
| JP | 2017-043051 | 3/2017 |
| JP | 2018-192756 | 12/2018 |
| JP | 2019-069575 | 5/2019 |
| JP | 2019-143675 | 8/2019 |

* cited by examiner

PRESSURE ADJUSTMENT UNIT, LIQUID EJECTING HEAD, AND LIQUID EJECTING APPARATUS

The present application is based on, and claims priority from JP Application Serial Number 2020-029066, filed Feb. 25, 2020, the disclosure of which is hereby incorporated by reference herein in its entirety.

BACKGROUND

1. Technical Field

The present disclosure relates to a pressure adjustment unit, a liquid ejecting head, and a liquid ejecting apparatus.

2. Related Art

A pressure adjustment unit that adjusts the pressure of a liquid supplied to a liquid ejecting head is known. In JP-A-2013-132895, as a valve body used for such a pressure adjustment unit, a valve body including a columnar shaft portion, a disc-shaped collar portion provided at an end portion of the shaft portion, and a sealing member disposed on the collar portion is disclosed. The valve body is positioned inside a valve body housing chamber by inserting the shaft portion thereof into a through hole through which a pressure chamber and the valve body housing chamber communicate with each other.

In the above-described configuration of the pressure adjustment unit, when the shaft portion of the valve body is inserted into the through hole, a distal end of the shaft portion may come into contact with a valve seat around the through hole and may be scraped.

SUMMARY

According to an aspect of the present disclosure, there is provided a pressure adjustment unit that has a first chamber, a second chamber, and a through hole which extends in a first direction from the first chamber to the second chamber and through which the first chamber communicates with the second chamber, the first chamber, the second chamber, and the through hole forming a flow path supplying a liquid to a nozzle that ejects the liquid. The pressure adjustment unit includes a valve body that has a base end portion housed in the first chamber, a shaft portion protruding in the first direction from the base end portion, and an elastic member provided on a first direction side of the base end portion; a casing that has a partition wall which partitions the first chamber and the second chamber and in which the through hole into which the shaft portion is inserted is formed, and that has a first wall which is annular and which protrudes in a second direction opposite to the first direction so as to define the first chamber, in which, on a first chamber side of the partition wall, a valve seat, which is annular, is provided around the through hole so as to block the flow path by coming into contact with the elastic member, an outer diameter of the base end portion is larger than an outer diameter of the shaft portion, an outer periphery of the base end portion has a positioning region in which a distance between an outer periphery surface of the base end portion and an inner periphery surface of the first wall is shorter than a distance between the shaft portion and an inner periphery surface of the through hole, and a distance in the first direction between a first-direction-side end portion of the positioning region and a first-direction-side distal end of the shaft portion is shorter than a distance in the first direction between the valve seat and a second-direction-side end portion of the first wall.

In another aspect of the present disclosure, a liquid ejecting head includes the pressure adjustment unit and the nozzle that ejects the liquid.

In yet another aspect of the present disclosure, a liquid ejecting apparatus includes the pressure adjustment unit, the nozzle that ejects the liquid, and a transport portion that transports a medium.

DESCRIPTION OF EXEMPLARY EMBODIMENTS

A. First Embodiment

Figure 1:
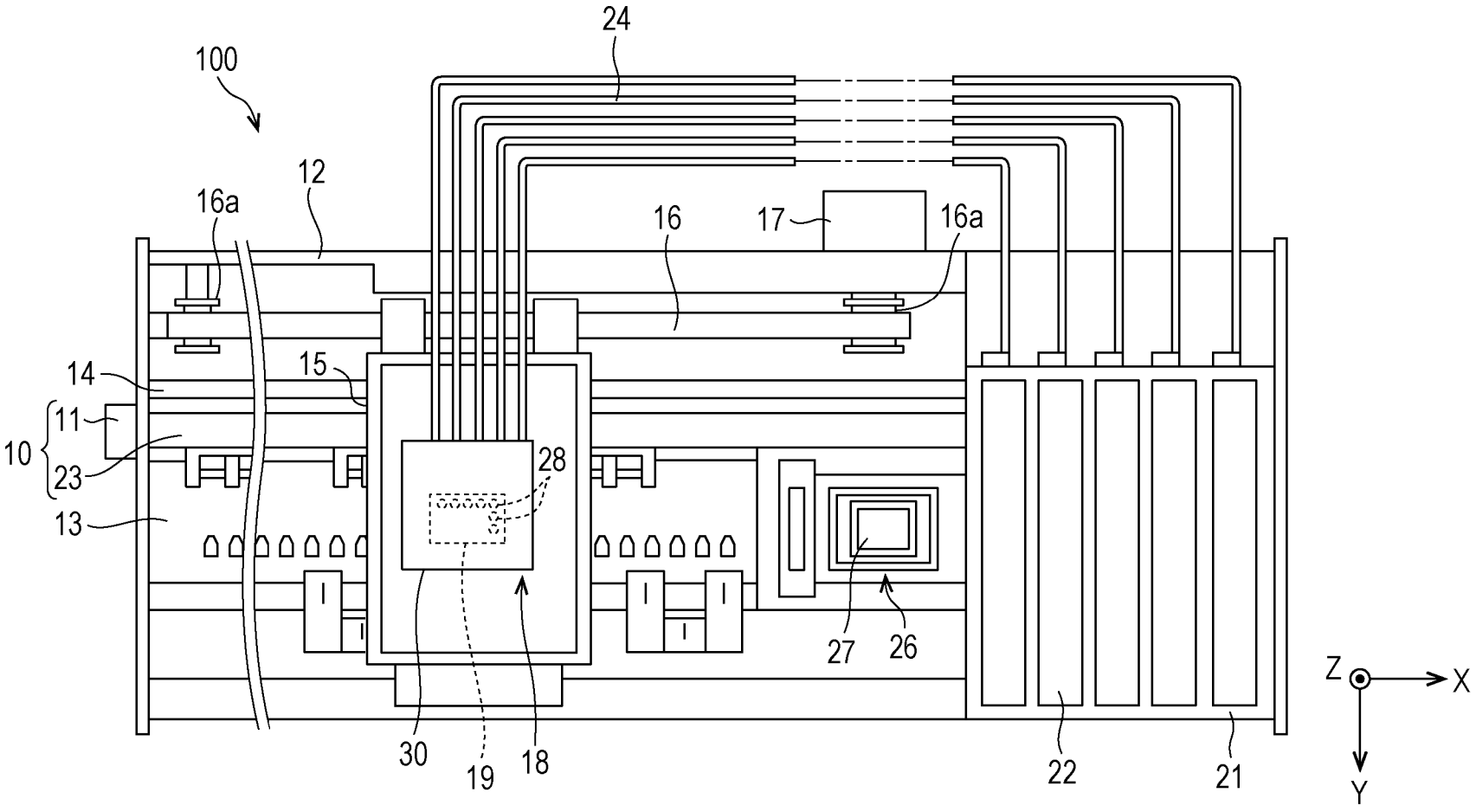
FIG. 1 is a plan view of a liquid ejecting apparatus according to a first embodiment.

FIG. 1 is a plan view of a liquid ejecting apparatus 100 according to a first embodiment. The liquid ejecting apparatus 100 in this embodiment is an ink jet printer. In FIG. 1, arrows indicating the +X direction, the +Y direction, and the +Z direction that are perpendicular to each other are illustrated. The +Z direction is a vertically upward direction when the liquid ejecting apparatus 100 is being used. The +X direction and the +Y direction are horizontal directions when the liquid ejecting apparatus 100 is being used. Hereinafter, the +Z direction is also referred to as "up", and the −Z direction is also referred to as "down". In addition, in the following, directions for which a positive or negative direction has not been specified are considered to include both positive and negative directions.

The liquid ejecting apparatus 100 includes a body frame 12 having a rectangular shape in plan view. A platen 13 extends inside the body frame 12 along the X direction, which is a main scanning direction. A medium such as printing paper is transported in the +Y direction onto the platen 13 by a transporting portion 10 formed of a platen roller 23 and a platen roller motor 11 that drives the platen roller 23. In the body frame 12, a guide shaft 14 that is rod-shaped and that extends in parallel with the platen 13 is installed on the +Z-direction side of the platen 13. A carriage 15 is supported on the guide shaft 14 in a state where the carriage 15 can reciprocate along the X direction.

The carriage 15 is coupled to a carriage motor 17, which is provided on a rear surface of the body frame 12, via a timing belt 16 that is endless and that is stretched over a pair of pulleys 16*a* provided on the body frame 12. The carriage 15 reciprocates along the guide shaft 14 when the carriage motor 17 is driven.

A liquid ejecting head 18 is provided on a −Z-direction end surface of the carriage 15 so as to face the platen 13. The liquid ejecting head 18 includes a head body 19 that ejects ink as a liquid, and a pressure adjustment unit 30 that supplies ink supplied from ink cartridges 22 to the head body 19.

A plurality of nozzles 28 are provided on a −Z-direction-side surface of the head body 19. By driving piezoelectric elements provided in the head body 19, ink droplets are ejected from each of the nozzles 28 onto a medium on the platen 13, and printing is performed.

A cartridge holder 21 is provided inside the body frame 12 at a +X-direction end portion thereof. The ink cartridges 22 as liquid supply sources are detachably attached to the cartridge holder 21. In this embodiment, five ink cartridges 22 are provided. The ink cartridges 22 house inks of different colors or types. Further, the cartridge holder 21 may be provided on the carriage 15.

The ink cartridges 22 mounted on the cartridge holder 21 are coupled to the pressure adjustment unit 30 via ink supply tubes 24. The pressure adjustment unit 30 adjusts the pressure of the ink supplied from the ink cartridges 22 via the ink supply tubes 24, and supplies the ink to the head body 19. Further, although only one pressure adjustment unit 30 is illustrated in FIG. 1, the pressure adjustment unit 30 is provided for each color or type of ink supplied from the ink cartridges 22.

In the body frame 12, a maintenance unit 26 for performing maintenance of the head body 19 is provided between the platen 13 and the cartridge holder 21. The maintenance unit 26 includes a cap 27 that surrounds the head body 19 and a suction pump configured to suck ink into the cap 27. By sucking the inside of the cap 27 with the suction pump while the cap 27 is in contact with the head body 19, thickened ink and air bubbles are forcibly discharged from the nozzles 28, and cleaning is performed.

Figure 2:
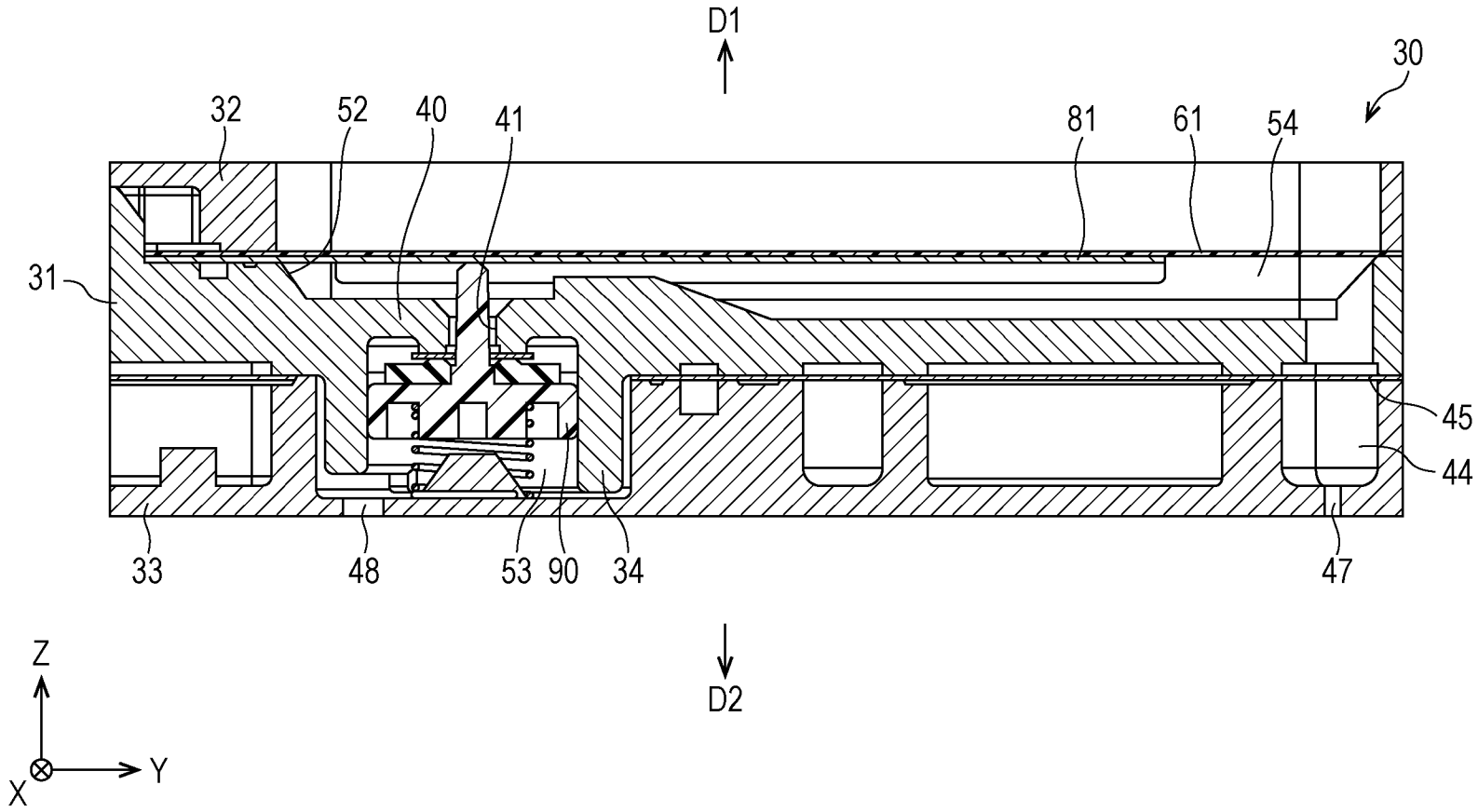
FIG. 2 is a sectional view of a pressure adjustment unit.

FIG. 2 is a sectional view of the pressure adjustment unit 30. The pressure adjustment unit 30 includes a casing 31, a cover member 32 disposed on an upper side of the casing 31, a sealing member 33 disposed on a lower side of the casing 31, a valve body 90, a first chamber 53, and a second chamber 54. The casing 31, the cover member 32, and the sealing member 33 are formed of, for example, a resin. The first chamber 53 and the second chamber 54 form a portion of a flow path for supplying ink to the nozzles 28. In the following, the +Z direction from the bottom to the top is also referred to as a "first direction D1". In addition, a direction opposite to the first direction D1, that is, the −Z direction from the upper side to the lower side is also referred to as a "second direction D2".

The casing 31 has a partition wall 40 that partitions the first chamber 53 and the second chamber 54, and a first wall 34 that is annular and that protrudes in the second direction D2 from the partition wall 40 so as to define the first chamber 53. In this embodiment, a second-direction-D2 end portion of the first wall 34 has a flat surface shape perpendicular to the second direction D2 except for a portion where a groove portion 35 described later is formed. The sealing member 33 is disposed below the casing 31. In this embodiment, the sealing member 33 is formed with a cylindrical recessed portion so as to cover the outer periphery of the first wall 34. By covering the first wall 34 with the sealing member 33, the first chamber 53 in which the valve body 90 is housed is defined. The first chamber 53 can also be referred to as a "valve housing chamber". The sealing member 33 is provided with an inflow port 48 that enables ink to flow into the first chamber 53. In this embodiment, a lower surface and an outer periphery surface of the first wall 34 and the sealing member 33 are not in close contact with each other, and a clearance is formed therebetween. The first chamber 53 is defined by adhering the upper surface of the sealing member 33 to the lower surface of the casing 31 around the first wall 34. Further, the first wall 34 and the sealing member 33 may be in close contact with each other. Here, it is sufficient that the inner periphery surface of the first wall 34 be annular, and the first wall 34 itself does not have to be annular. In addition, the term "annular" is not limited to a shape in which the entire periphery is continuous, and when the entire periphery is circular, in a portion thereof, there may be a non-continuous portion due to the formation of a slit, groove portion, recessed portion, or the like.

An opening 52 that is recessed is formed on an upper surface side of the casing 31, and a film 61, which is flexible and which is formed of a resin, is disposed so as to cover the opening 52. The film 61 is adhered to and fixed to the casing 31 together with the cover member 32. The second chamber 54 is defined between the casing 31 and the film 61 by disposing the film 61 so as to cover the opening 52. The second chamber 54 can also be referred to as a "pressure chamber". A surface of the film 61 on the side opposite to the side on which the second chamber 54 is provided is in contact with the atmosphere.

A pressure receiving member 81 is disposed on the surface of the film 61 on the side on which the second chamber 54 is provided. The pressure receiving member 81 is formed of, for example, a thin plate such as SUS. One end of the pressure receiving member 81 is supported at a joint portion between the casing 31 and the cover member 32. When the film 61 bends in the second direction D2, the pressure receiving member 81 is also displaced in the second direction D2 in accordance with the bending of the film 61. The film 61 and the pressure receiving member 81 may or may not be adhered to each other. The pressure receiving member 81 in this embodiment, when viewed in the −Y direction, is formed in a downward U shape. Further, the pressure receiving member 81 may have a flat shape.

A filter chamber 44 defined by a recessed portion provided in the sealing member 33 is disposed below a +Y-direction-side end portion of the second chamber 54. The filter chamber 44 and the second chamber 54 communicate with each other via a filter 45. The filter 45 is fixed between the sealing member 33 and the casing 31 by being adhered to the sealing member 33 and the casing 31. The filter 45 removes contaminants and the like contained in ink flowing from the second chamber 54 into the filter chamber 44. The filter 45 is formed of, for example, a metal mesh, a non-woven fabric, or the like. At a bottom surface of the filter chamber 44, an outflow hole 47 for letting ink from which contaminants and the like have been removed by the filter 45 flow out to the head body 19 is open. Further, in this embodiment, the pressure adjustment unit 30 includes the filter 45; however, the pressure adjustment unit 30 need not include the filter 45.

Figure 3:
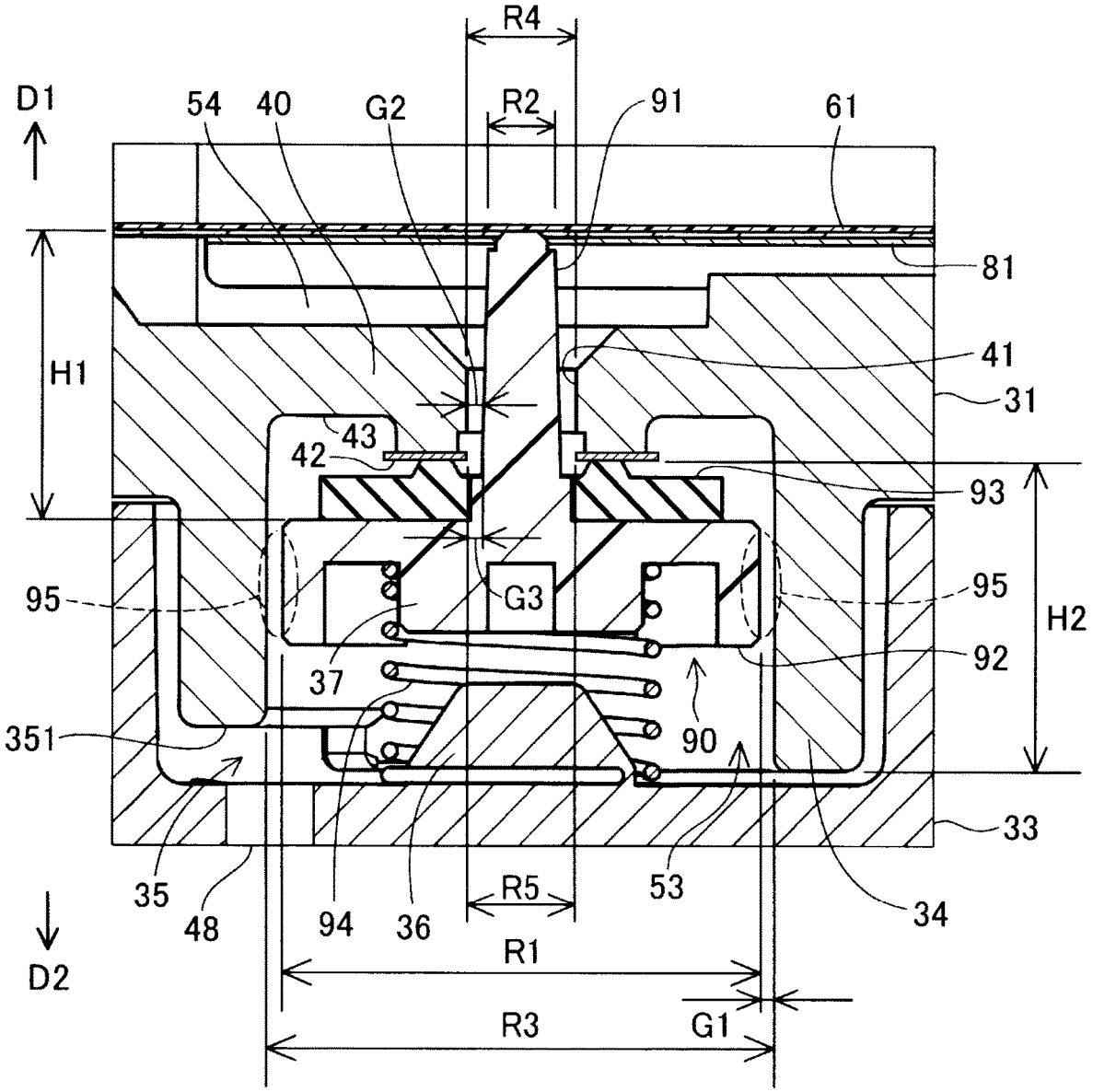
FIG. 3 is an enlarged view of the vicinity of a first chamber.
Figure 4:
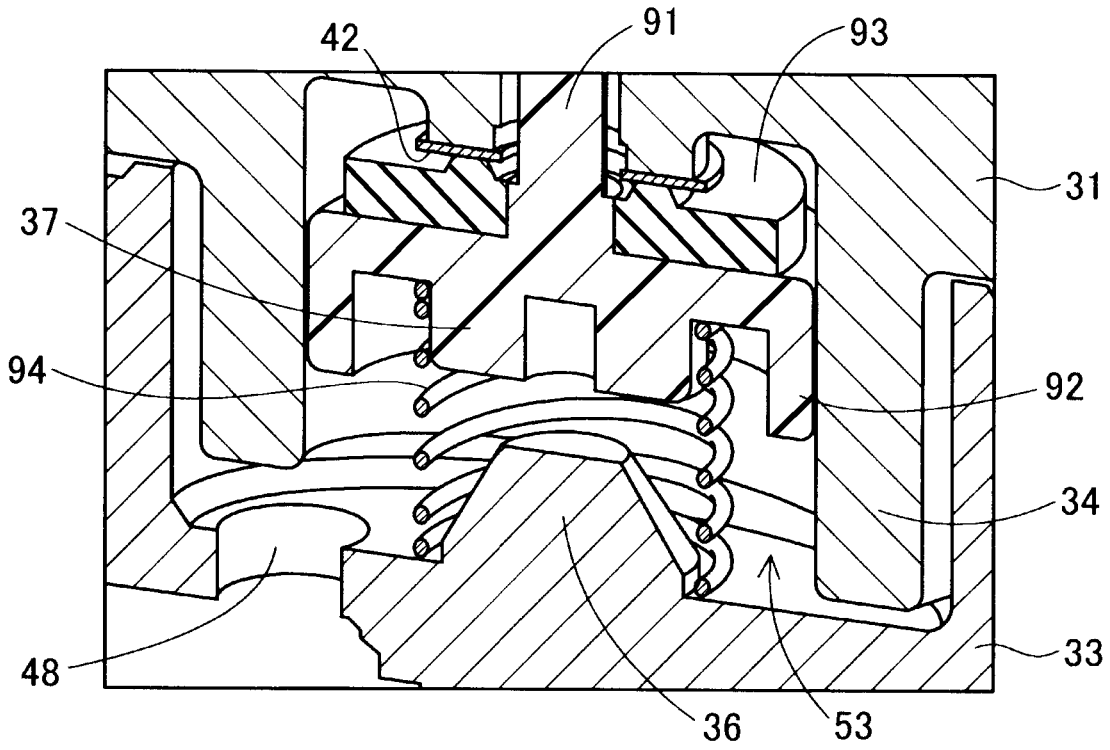
FIG. 4 is a perspective sectional view of the vicinity of the first chamber.

FIG. 3 is an enlarged view of the vicinity of the first chamber 53 in FIG. 2. FIG. 4 is a perspective sectional view of the vicinity of the first chamber 53. The partition wall 40 is formed with a through hole 41 that extends in the first direction D1 from the first chamber 53 toward the second chamber 54 and through which the first chamber 53 and the second chamber 54 communicate with each other.

The valve body 90 has a base end portion 92 housed in the first chamber 53, a shaft portion 91 that is columnar and that protrudes in the first direction D1 from the base end portion 92, and an elastic member 93 provided on an upper surface side of the base end portion 92. In this embodiment, the base end portion 92 and the shaft portion 91 are formed of a resin such as polypropylene or polyparaphenylene benzobisoxazole. The elastic member 93 is formed of an elastic rubber.

The base end portion 92 in this embodiment has a substantially disc-like shape. An outer diameter R1 of a cross section of the base end portion 92 perpendicular to the first direction D1 is larger than an outer diameter R2 of a cross section of the shaft portion 91 perpendicular to the first direction D1. The base end portion 92 can also be referred to as a flange portion or a collar portion. The shaft portion 91 is inserted into the through hole 41 formed in the partition wall 40, and a distal end thereof comes into contact with the pressure receiving member 81 disposed in the second chamber 54. The elastic member 93 is provided inside an outer periphery of the base end portion 92 and outside the shaft portion 91 when viewed in the second direction D2. On an upper surface side of the elastic member 93, a protrusion is formed at a portion in contact with a valve seat 42. The elastic member 93 is not provided on a portion of a side surface of the shaft portion 91 that is inserted into the through hole 41 and is not provided on an outer periphery surface of the base end portion 92.

The valve seat 42, which is annular, is provided around the through hole 41 on a surface of the partition wall 40 on the side on which the first chamber 53 is provided. The flow path through which ink flows to the nozzles 28 is blocked by the valve seat 42 coming into contact with the elastic member 93 provided on the valve body 90. In this embodiment, the valve seat 42 is formed independently of the partition wall 40 and is formed of a metal. As the metal, for example, SUS or titanium can be used. The surface of the valve seat 42 that comes into contact with the elastic member 93 may be subjected to a liquid repellent treatment such as fluorine coating. The valve seat 42 is fixed to the partition wall 40 with an adhesive.

In this embodiment, the partition wall 40, when viewed in the first direction D1, has a recessed portion 43 that is annular and recessed in the first direction D1 from a portion outside the portion where the valve seat 42 is provided. The recessed portion 43 has a function of accepting excess adhesive squeezed out from between the valve seat 42 and the partition wall 40 when the valve seat 42 is adhered to the partition wall 40.

In the first chamber 53, a coil spring 94, which is an example of an urging member, is interposed between the sealing member 33 and the base end portion 92. A second-direction-D2-side end portion of the coil spring 94 is positioned by a first projecting portion 36 that has a truncated cone shape and that is formed on an upper surface of the sealing member 33. In addition, a first-direction-D1-side end portion of the coil spring 94 fits into a second projecting portion 37 formed on a second-direction-D2-side surface of the base end portion 92 of the valve body 90. Further, as the urging member, for example, a leaf spring or a disc spring can be used instead of the coil spring.

Figure 5:
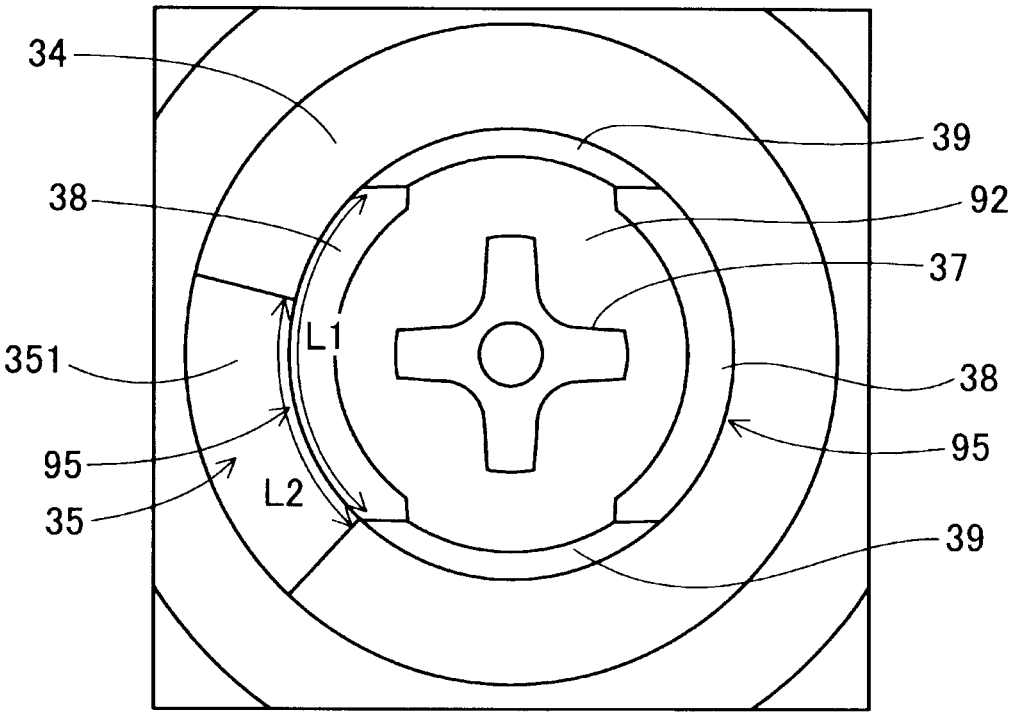
FIG. 5 is a bottom view of the vicinity of a base end portion.
Figure 6:
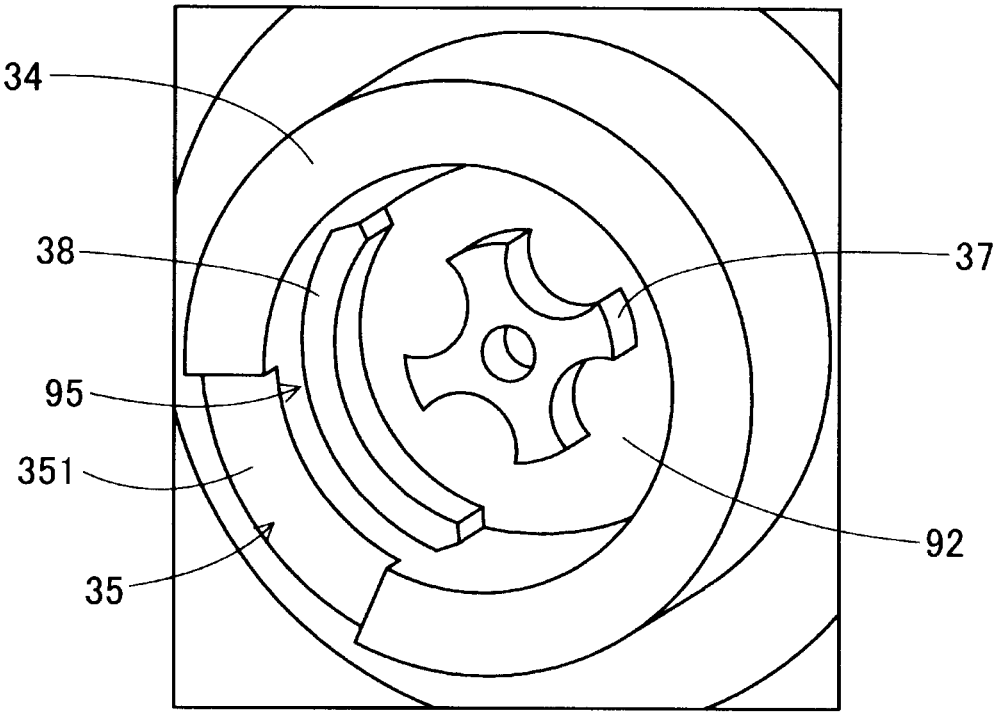
FIG. 6 is a perspective view of the vicinity of the base end portion.

FIG. 5 is a bottom view of the vicinity of the base end portion 92, and FIG. 6 is a perspective view of the vicinity of the base end portion 92. In this embodiment, the second projecting portion 37 into which a first-direction-D1-side end portion of the coil spring 94 is fitted is formed in a substantially cross-like shape. The base end portion 92, on an outer periphery portion thereof, has sliding contact portions 38 configured to be in sliding contact with an inner periphery surface of the first wall 34. The sliding contact portions 38 protrude in the second direction D2 from the lower surface of the base end portion 92. In this embodiment, the sliding contact portions 38 are provided at two positions facing each other so as to flank the second projecting portion 37. Portions of the base end portion 92 where the sliding contact portions 38 are not provided form clearances 39 with the first wall 34. In this embodiment, the clearances 39 are provided at two positions so as to flank the second projecting portion 37. The ink that has flowed into the first chamber 53 from the inflow port 48 passes through the clearances 39 and goes from the first chamber 53 toward the through hole 41. Further, the number of the sliding contact portions 38 and the clearances 39 can be arbitrarily set, and the sliding contact portions 38 and the clearances 39 may be at one location or three or more locations. Further, it is sufficient that the sliding contact portions 38 be in sliding contact with the first wall 34, and the sliding contact portions 38 need not always be in sliding contact with the first wall 34. For example, among the plurality of sliding contact portions 38, one that is not actually in sliding contact with the first wall 34 may be included.

The groove portion 35 recessed in the first direction D1 is provided in a portion of the first wall 34, more specifically, a portion of a second-direction-D2-side end portion of the first wall 34. The groove portion 35 penetrates the first wall 34 in a radial direction and communicates with the first chamber 53. As illustrated in FIG. 3, the groove portion 35 is provided in a portion of the first wall 34 where the inflow port 48 provided in the sealing member 33 opens to the first chamber 53. That is, the inflow port 48 and the groove portion 35, when viewed in the first direction D1, have a range of overlap. The ink flowing in from the inflow port 48 flows into the first chamber 53 via the groove portion 35. In this embodiment, the depth of the groove portion 35 along the first direction D1, that is, the distance from a second-direction-D2 end portion of the first wall 34 to a bottom surface 351 of the groove portion 35 is smaller than the maximum thickness of the base end portion 92, that is, the thickness along the first direction D1 of the sliding contact portions 38 provided on the base end portion 92. Further, the depth of the groove portion 35 along the first direction D1 is not limited to this, and can be arbitrarily set. In this embodiment, the groove portion 35 is provided at one location on the first wall 34; however, it may be provided at a plurality of locations.

As illustrated in FIG. 3, in this embodiment, the outer periphery of the base end portion 92 has positioning regions 95 in which a distance G1 between the outer periphery surface of the base end portion 92 and the inner periphery surface of the first wall 34 is shorter than a distance G2, which is the shortest distance, between the shaft portion 91 and the inner periphery surface of the through hole 41. In this embodiment, the positioning regions 95 are located on the outer periphery surface of the sliding contact portions 38. Hereinafter, the distance G1 is also referred to as a gap G1 between the base end portion 92 and the first wall 34, and the distance G2 is also referred to as a gap G2 between the shaft portion 91 and the through hole 41. That is, in this embodiment, the gap G1 between the base end portion 92 and the first wall 34 is smaller than the gap G2 between the shaft portion 91 and the through hole 41. The gap G1 between the base end portion 92 and the first wall 34 is such that the sliding contact portion 38 can slide with respect to the inner periphery surface of the first wall 34. Further, the gap G1, when seen in plan view in the first direction D1, can be referred to as the difference between the distance from the center of the base end portion 92 to the outer periphery surface of the base end portion 92 and the distance from the center of the first chamber 53 to the inner periphery surface of the first wall 34. In addition, the gap G2, when seen in plan view in the first direction D1, can be referred to as the difference between the maximum distance from the center of the shaft portion 91 to the outer periphery surface of the portion of the shaft portion 91 inserted into the through hole 41 and the shortest distance from the center of the through hole 41 to the inner periphery surface of the through hole 41. Furthermore, the gap G1 can be referred to as a value that is half the difference between an inner diameter R3 of the first chamber 53 and an outer diameter R1 of the base end portion 92. In addition, the gap G2 can be referred to as a value that is half the difference between an inner diameter R4 of the through hole 41 and an outer diameter R2 of the portion of the shaft portion 91 inserted into the through hole 41.

In addition, as illustrated in FIG. 3, in this embodiment, the gap G1 is shorter than a distance G3, which is the shortest distance between the shaft portion 91 and the inner periphery surface of the valve seat 42. Hereinafter, the distance G3 is also referred to as a gap G3 between the shaft portion 91 and the valve seat 42. That is, in this embodiment, the gap G1 between the base end portion 92 and the first wall 34 is smaller than the gap G3 between the shaft portion 91 and the valve seat 42. In this embodiment, the gap G2 and the gap G3 are substantially the same. Further, the gap G3, when seen in plan view in the first direction D1, can be referred to as the difference between the maximum distance from the center of the shaft portion 91 to the outer periphery surface of the portion of the shaft portion 91 inserted into the through hole of the valve seat 42 and the shortest distance from the center of the through hole of the valve seat 42 to the inner periphery surface of the through hole of the valve seat 42. Furthermore, the gap G3 can be referred to as a value that is half the difference between an inner diameter R5 of the valve seat 42 and the outer diameter R2 of the portion of the shaft portion 91 inserted into the through hole of the valve seat 42.

In addition, in this embodiment, a distance H1 in the first direction D1 between a first-direction-D1-side end portion of the positioning regions 95 and a first-direction-D1-side distal end of the shaft portion 91 is shorter than a distance H2 in the first direction D1 between the valve seat 42 and a second-direction-D2-side end portion of the first wall 34. Here, "a second-direction-D2-side end portion of the first wall 34" refers to the position of the furthest second-direction-D2-side end on the inner periphery surface of the first wall 34 at which the base end portion 92 of the valve body 90 can be in sliding contact. In other words, "the second-direction-D2-side end portion of the first wall 34" can be said to be the position of the furthest second-direction-D2-side end on the inner periphery surface of the first wall 34 having a portion whose distance to the positioning regions 95 is shorter than the distance G2. Hereinafter, the distance H1 is also referred to as the length H1 of the shaft portion 91, and the distance H2 is also referred to as the depth H2 of the first chamber 53. That is, in this embodiment, the length H1 of the shaft portion 91 is smaller than the depth H2 of the first chamber 53.

Furthermore, in this embodiment, as illustrated in FIG. 5, when the base end portion 92 and the first wall 34 are viewed in the first direction D1, a continuous length L1 of the positioning regions 95 along the outer periphery of the base end portion 92 is larger than a continuous length L2 along the inner periphery surface of the first wall 34 of the bottom surface 351 of the groove portion 35. The "continuous length" does not mean the total length of a plurality of lengths, but one of the lengths of the positioning regions 95 or the bottom surfaces 351 of the groove portions 35 when there are pluralities thereof. When there are a plurality of positioning regions 95 and a plurality of groove portions 35, it is preferable that the length of the positioning region 95 having the smallest length among the positioning regions 95 be larger than the length of the groove portion 35 having the longest length among the groove portions 35.

The opening/closing operation of the valve body 90 configured as described above will be described. In the following description, it is assumed that the first chamber 53 and the second chamber 54 are filled with ink by the initial filling of the nozzles 28 with ink or the previous ejection of ink. As illustrated in FIG. 3, the coil spring 94 always urges the valve body 90 in the first direction D1, which is the direction in which the valve body 90 is closed. In the closed valve state of the valve body 90, the elastic member 93 is in contact with the valve seat 42 and the through hole 41 is closed, that is, the first chamber 53 and the second chamber 54 are in a non-communication state.

With the first chamber 53 and the second chamber 54 in a non-communication state, when ink is ejected from the head body 19, the ink in the second chamber 54 is reduced. As a result, the second chamber 54 attains a negative pressure due to the differential pressure from the atmospheric pressure, and the film 61 and the pressure receiving member 81 are displaced so as to bend toward the second chamber 54. Then, the pressure receiving member 81 pushes a distal end of the shaft portion 91 in the second direction D2, and the valve body 90 is pushed down toward the first chamber 53.

When the valve body 90 is pushed down against the urging force of the coil spring 94, which is a pressure coil spring, the elastic member 93 is separated from the valve seat 42, and the valve body 90 becomes open. When the valve body 90 is in the open valve state, the through hole 41 is open, that is, the first chamber 53 and the second chamber 54 are in a communication state.

When the valve body 90 is in the open valve state, the ink in the first chamber 53 flows into the second chamber 54 through the through hole 41. When the second chamber 54 is sufficiently replenished with ink, the negative pressure inside the second chamber 54 is eliminated, the pressure receiving member 81 and the film 61 return to their original positions, and the valve body 90 is closed by the urging force of the coil spring 94. By opening and closing the valve body 90 in this way, the second chamber 54 is always adjusted to a substantially constant pressure.

Figure 7:
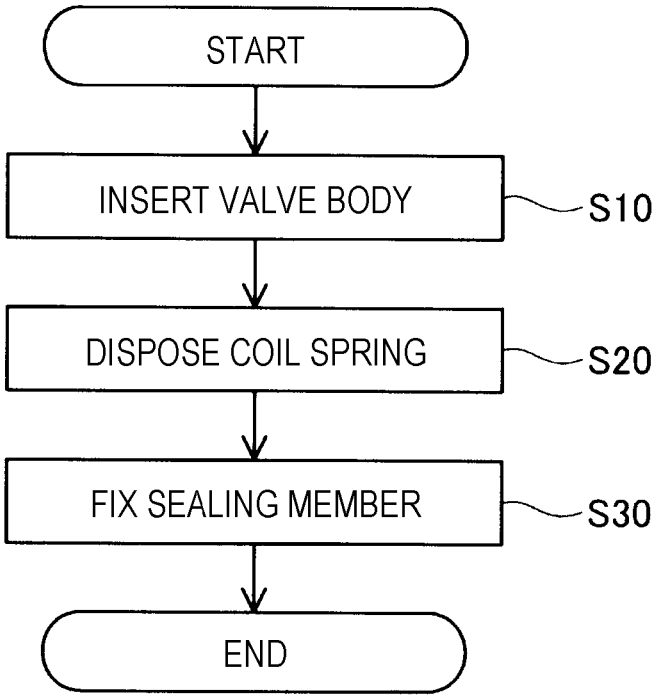
FIG. 7 is a process diagram illustrating a portion of the manufacturing process of the pressure adjustment unit.

FIG. 7 is a process diagram illustrating a portion of the manufacturing process of the pressure adjustment unit 30. FIG. 7 illustrates a process for forming the first chamber 53 in the manufacturing process of the pressure adjustment unit 30.

First, in the first step S10, the valve body 90 is inserted into the first wall 34. More specifically, first, with the shaft portion 91 of the valve body 90 facing toward the through hole 41, the base end portion 92 is positioned within the first wall 34 by causing a portion of the positioning regions 95 of the base end portion 92 of the valve body 90 to come into sliding contact with the inner periphery surface of the first wall 34. Then, in that state, the valve body 90 is moved toward the through hole 41 in such a manner that the shaft portion 91 is inserted into the through hole 41. That is, the positioning regions 95 function as guides when the valve body 90 is inserted into the first wall 34.

In the second step S20, the coil spring 94 is disposed on a rear surface side of the base end portion 92 by using the second projecting portion 37, which is cross-shaped and illustrated in FIGS. 5 and 6.

In the third step S30, the sealing member 33 is disposed on a second-direction-D2-side surface of the casing 31 so that the first projecting portion 36 formed on the sealing member 33 is inserted into the coil spring 94 and the sealing member 33 is adhered to and fixed to the casing 31. The first chamber 53 is formed by the series of steps described above. Further, it is preferable that each step from the first step S10 to the third step S30 be performed in a state where the first wall 34 faces vertically upward and the through hole 41 faces vertically downward. By performing each step in such a state, it is possible to suppress the valve body 90 and the coil spring 94 from falling.

Figure 8:
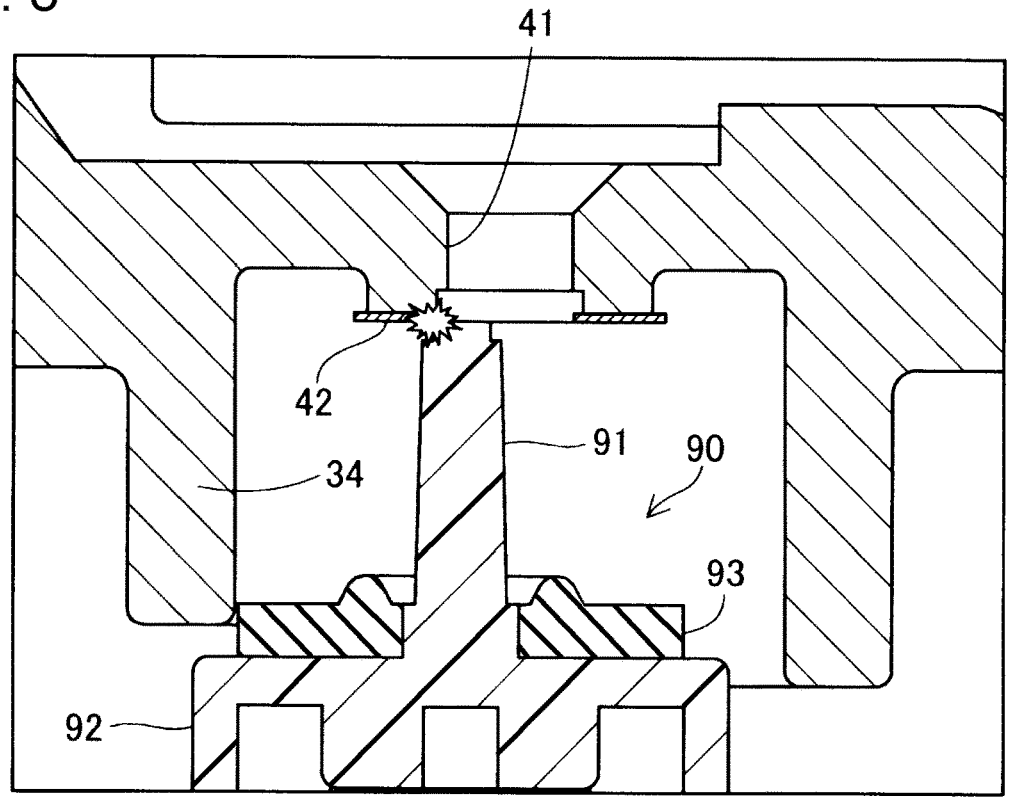
FIG. 8 is a diagram illustrating a comparative example of a valve body.
Figure 9:
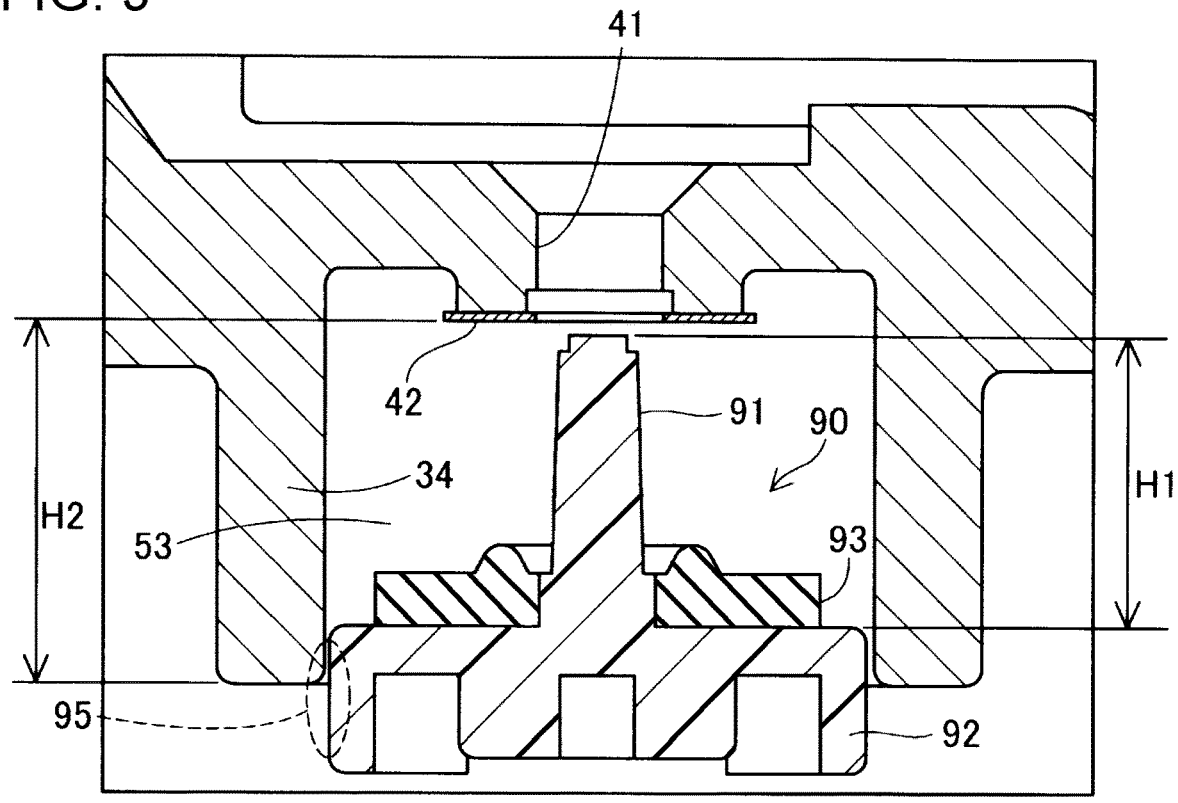
FIG. 9 is a diagram illustrating an effect of the first embodiment.

According to the pressure adjustment unit 30 of this embodiment described above, the length H1 of the shaft portion 91 is smaller than the depth H2 of the first chamber 53, and, furthermore, the gap G1 between the base end portion 92 and the first wall 34 is smaller than the gap G2 between the shaft portion 91 and the through hole 41. Therefore, for example, in the case where the length H1 of the shaft portion 91 is larger than the depth H2 of the first chamber 53, as illustrated in FIG. 8, when disposing the valve body 90 in the first chamber 53 in the manufacturing process of the pressure adjustment unit 30, since the shaft portion 91 is inserted into the through hole 41 before the base end portion 92 is inserted into the first wall 34, the distal end of the shaft portion 91 may come into contact with the valve seat 42 and be scraped. However, in this embodiment, as illustrated in FIG. 9, since the length H1 of the shaft portion 91 is smaller than the depth H2 of the first chamber 53, first, the base end portion 92 is positioned in the first chamber 53 by the positioning regions 95 of the base end portion 92, and then the shaft portion 91 is inserted into the through hole 41. Moreover, in this embodiment, as illustrated in FIG. 3, since the gap G1 between the base end portion 92 and the first wall 34 is smaller than the gap G2 between the shaft portion 91 and the through hole 41, the shaft portion 91 can be inserted into the through hole 41 after the base end portion 92 has been accurately positioned in the first chamber 53. Therefore, according to this embodiment, it is possible to effectively prevent the distal end of the shaft portion 91 from coming into contact with the valve seat 42 around the through hole 41 and being scraped.

In addition, in this embodiment, the elastic member 93 provided in the valve body 90 is provided inside the outer periphery of the base end portion 92 and outside the shaft portion 91 when viewed in the second direction D2. Therefore, the size of the elastic member 93 can be reduced. Furthermore, since the outer periphery of the base end portion 92 is not covered with the elastic member 93, the positioning accuracy of the base end portion 92 with respect to the first chamber 53 can be improved. If the outer periphery of the base end portion 92 is covered with the elastic member 93, as the elastic member 93 comes into contact with the inner periphery surface of the first wall 34 and bends, the positioning accuracy of the base end portion 92 with respect to the first chamber 53 is lowered.

In addition, in this embodiment, the valve seat 42 disposed around the through hole 41 is formed of a metal. Therefore, the surface roughness of the valve seat 42 becomes smaller than that of the resin, and ink components are suppressed from being deposited on the valve seat 42. As a result, the sealing property of the valve body 90 can be improved. In addition, since the valve seat 42 is formed of a metal, it becomes easy to apply a liquid repellent treatment to the valve seat 42, thus the accumulation of ink components can be suppressed more effectively. In addition, in this embodiment, although the valve seat 42 is formed of a metal and the shaft portion 91 of the valve body 90 is formed of resin, at the time of manufacturing the pressure adjustment unit 30, as described above, since the valve body 90 is positioned with respect to the casing 31 by the base end portion 92 and the first wall 34 before the shaft portion 91 is inserted into the through hole 41, it is possible to suppress the distal end of the shaft portion 91 from coming into contact with the valve seat 42, which is formed of a metal, and being scraped.

In addition, in this embodiment, the groove portion 35 recessed in the first direction D1 is provided in a portion of the first wall 34 forming the first chamber 53 at a portion where the inflow port 48 provided in the sealing member 33 opens to the first chamber 53, and the groove portion 35 communicates with the first chamber 53. Therefore, the pressure loss when the ink flows from the inflow port 48 to the first chamber 53 can be reduced.

In addition, in this embodiment, when the base end portion 92 and the first wall 34 are viewed in the first direction D1, the continuous length of the positioning regions 95 is larger than the continuous length of the bottom surface 351 of the groove portion 35. Therefore, It is possible to prevent the movement of the valve body 90 along the first direction D1 from being hindered as a result of fitting the base end portion 92 of the valve body 90 into the groove portion 35. In addition, in this embodiment, since the depth of the groove portion 35 along the first direction D1 is smaller than the thickness of the base end portion 92 along the first direction D1, the base end portion 92 can be more effectively suppressed from being accidentally fitted into the groove portion 35.

B. Second Embodiment

Figure 10:
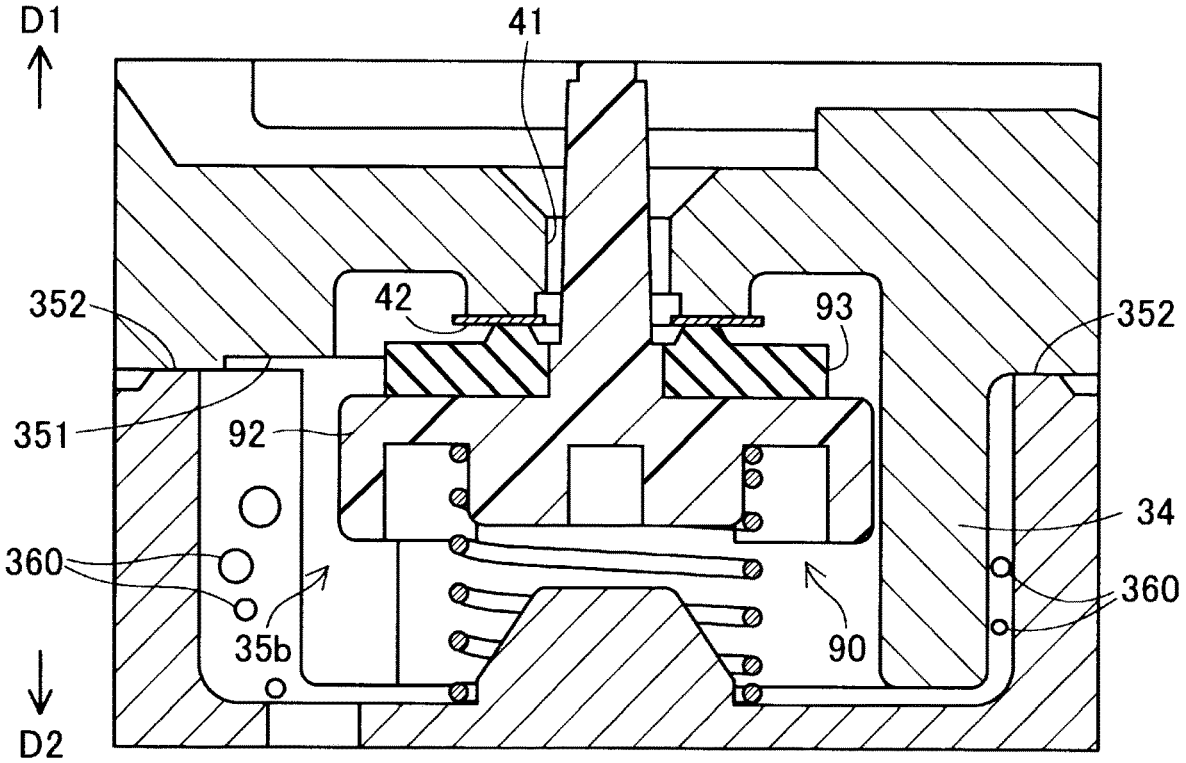
FIG. 10 is a diagram illustrating a configuration of a first wall according to a second embodiment.

FIG. 10 is a diagram illustrating a configuration of the first wall 34 according to a second embodiment. The shape of the groove portion 35 provided on the first wall 34 in the first embodiment and the shape of a groove portion 35*b* provided on the first wall 34 in the second embodiment are different. Specifically, in the first embodiment, while the depth of the groove portion 35 is set smaller than the thickness of the base end portion 92, in the second embodiment, the position of the bottom surface 351 of the groove portion 35*b* is set so as to be located on the first-direction-D1 side of a fixing surface 352 at which the sealing member 33 and the casing 31 are fixed.

According to the second embodiment configured as described above, since the bottom surface 351 of the groove portion 35*b* is located on the first-direction-D1 side of the fixing surface 352 at which the sealing member 33 and the casing 31 are fixed, even when bubbles 360 flow into a gap between the outer periphery surface of the first wall 34 and the sealing member 33 from the inflow port 48, the bubbles can be easily discharged from the through hole 41 through the groove portion 35*b* at the time of valve opening. Further, in order to improve the discharge of bubbles, the bottom surface 351 and the fixing surface 352 of the groove portion 35*b* are preferably disposed at positions on the second direction D2 side of the valve seat 42.

C. Third Embodiment

Figure 11:
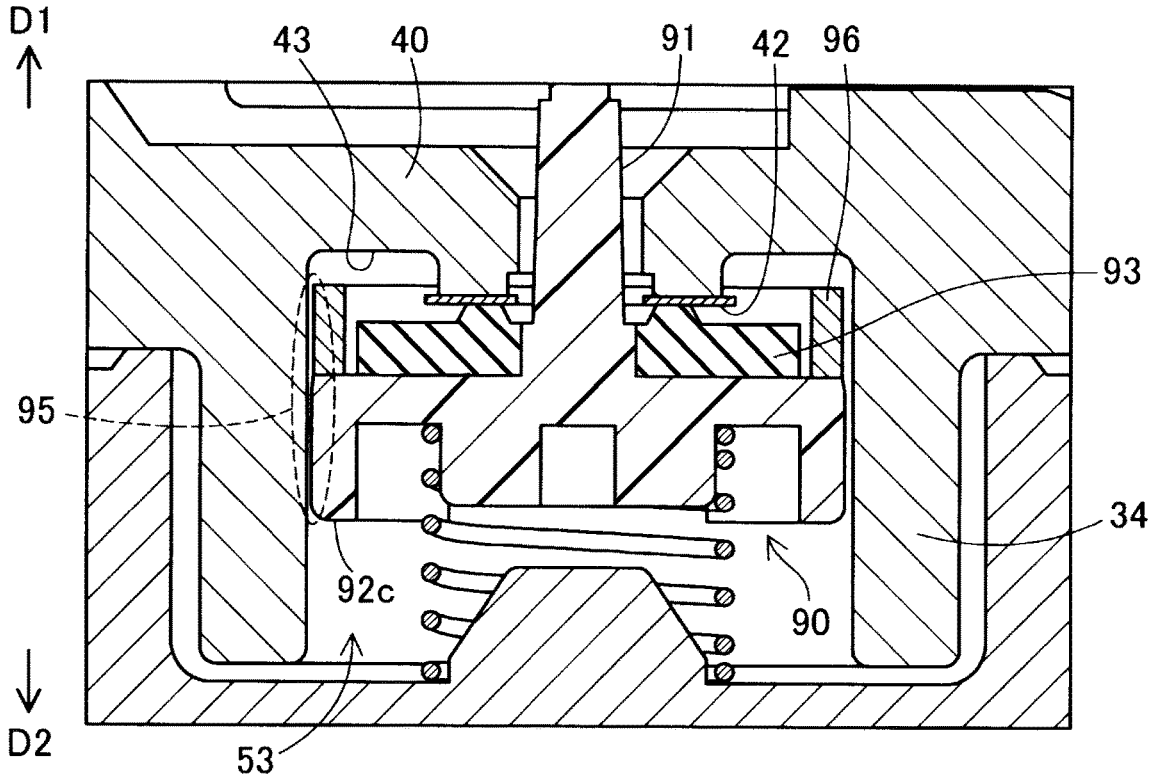
FIG. 11 is a diagram illustrating a configuration of a valve body according to a third embodiment.

FIG. 11 is a diagram illustrating a configuration of the valve body 90 according to a third embodiment. The configuration of the base end portion 92 of the valve body 90 in the first embodiment and the configuration of a base end portion 92*c* of the valve body 90 in the third embodiment are different. Specifically, in the third embodiment, the base end portion 92*c* includes a projecting portion 96 that protrudes in the first direction D1 from a surface on which the shaft portion 91 is provided on the outer periphery portion of the base end portion 92*c*. The projecting portion 96 may be integrally formed with the base end portion 92*c*, or may be formed as a separate body from the base end portion 92*c* and may be joined to the base end portion 92*c*. In this embodiment, the projecting portion 96 is formed in an annular shape along the outer shape of the base end portion 92*c*. The projecting portion 96 is integrated with the base end portion 92*c* to form the positioning region 95. That is, the projecting portion 96 functions as a portion of the positioning region 95. Further, the projecting portion 96 is not limited to an annular shape, and for example, a plurality of columnar projecting portions may be disposed at predetermined intervals on the surface of the base end portion 92*c* provided with the shaft portion 91.

In this embodiment, similarly to the first embodiment, the partition wall 40, when viewed in the first direction D1, includes the recessed portion 43 that is annular and recessed in the first direction D1 from the portion outside the portion where the valve seat 42 is provided. The recessed portion 43 and the projecting portion 96 overlap each other when viewed in the first direction D1. The projecting portion 96, in the closed valve state in which the valve body 90 and the valve seat 42 are in contact with each other, protrudes in the first direction D1 further than the contact surface between the valve seat 42 and the elastic member 93.

According to the third embodiment described above, since the projecting portion 96 is provided on the base end portion 92*c*, the length of the base end portion 92*c* in the first direction D1 can be substantially increased. That is, the length along the first direction D1 from a distal end of the projecting portion 96, which is an end portion on the first direction D1 side of the positioning regions 95, to the distal end of the shaft portion 91 on the first direction D1 side can be shortened. As a result, because the length of the shaft portion 91 can be made substantially relatively small, it is not necessary to increase the length of the first wall 34 along the first direction D1 in order to make the length of the shaft portion 91 smaller than the depth of the first chamber 53. Therefore, it is possible to suppress an increase in the size of the pressure adjustment unit 30. In particular, in this embodiment, since the partition wall 40 is provided with the recessed portion 43, the size of the base end portion 92*c* along the first direction D1 can be made larger, consequently, it is possible to more effectively suppress an increase in the size of the pressure adjustment unit 30.

Further, an outer periphery surface of the projecting portion 96 and an outer periphery surface of the base end portion 92*c* may be the same surface, and the outer periphery surface of the projecting portion 96 may be located inside the outer periphery surface of the base end portion 92*c*. When the outer periphery surface of the projecting portion 96 is located inside the outer periphery surface of the base end portion 92*c*, the gap between the outer periphery surface of the projecting portion 96 and the inner periphery surface of the first wall 34 is smaller than the gap G2 between the shaft portion 91 and the through hole 41.

In addition, in this embodiment, the partition wall 40 is provided with the recessed portion 43; however, the partition wall 40 need not be provided with the recessed portion 43. In this case, it is preferable that the length of the projecting portion 96 along the first direction D1 be smaller than the thickness of the elastic member 93 along the first direction D1 so that the projecting portion 96 does not come into contact with the partition wall 40 in the closed valve state.

D. Fourth Embodiment

Figure 12:
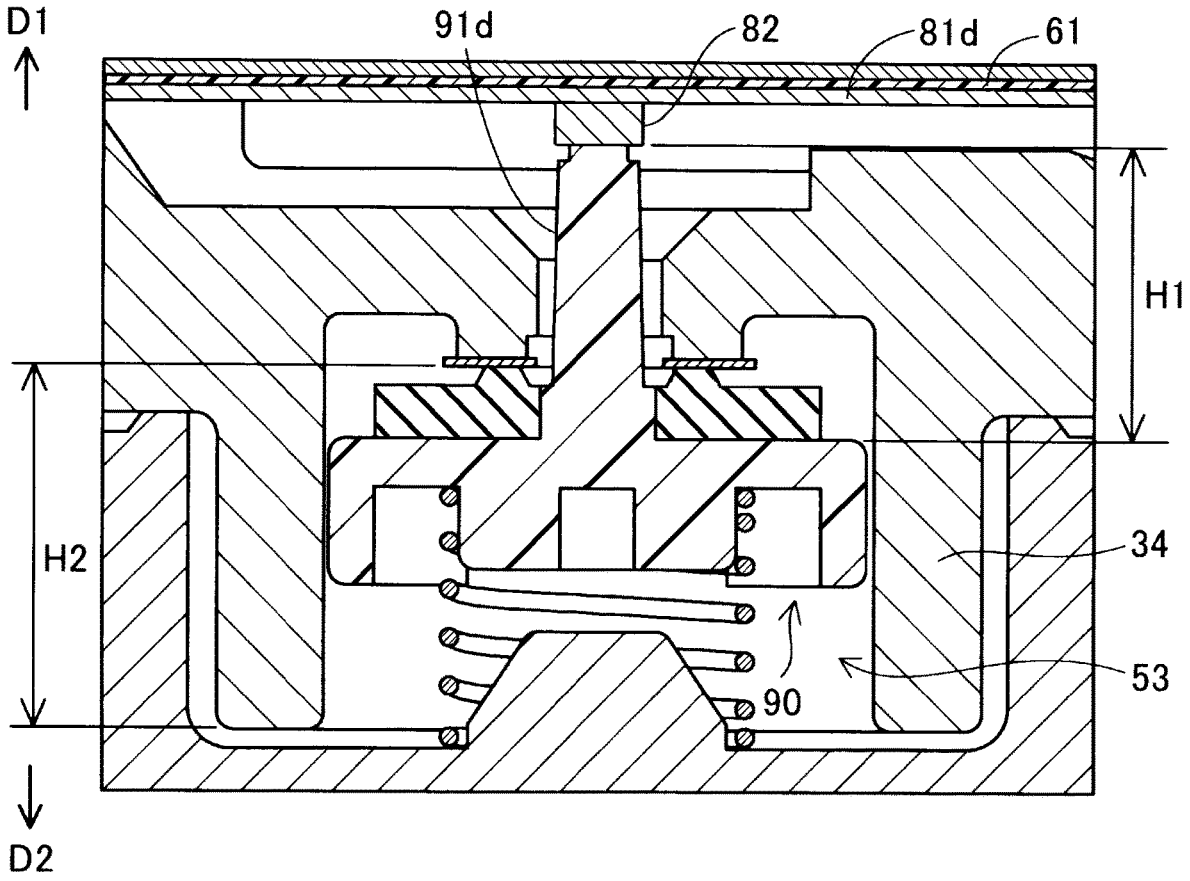
FIG. 12 is a diagram illustrating a configuration of a pressure receiving member according to a fourth embodiment.

FIG. 12 is a diagram illustrating a configuration of a pressure receiving member 81*d* according to a fourth embodiment. The length of the shaft portion 91 of the valve body 90 and the configuration of the pressure receiving member 81 in the first embodiment and the length of a shaft portion 91*d* of the valve body 90 and the configuration of the pressure receiving member 81*d* in the fourth embodiment are different. In the fourth embodiment, the pressure receiving member 81*d* is provided with a protrusion 82 that is columnar and that protrudes in the second direction D2 at a portion of contact with the shaft portion 91*d*. The protrusion 82 is, for example, formed of the same material as the pressure receiving member 81, and is adhered or welded to the pressure receiving member 81*d*. Further, the protrusion 82 may be formed integrally with the pressure receiving member 81. In addition, the shape of the protrusion 82 is not limited to a columnar shape, and may be a prismatic shape or a hemispherical shape. In addition, the material of the protrusion 82 may be a material different from that of the pressure receiving member 81.

In this embodiment, the length H1 of the shaft portion 91*d* along the first direction D1 is smaller than that in the first embodiment. Specifically, the length H1 of the shaft portion 91*d* is set smaller than that in the first embodiment by an amount equal to the length of the protrusion 82 along the first direction D1. That is, in the fourth embodiment, the sum of the length H1 of the shaft portion 91*d* and the length of the protrusion 82 is the value of the length H1 of the shaft portion 91 in the first embodiment.

According to the fourth embodiment described above, the length of the shaft portion 91*d* can be shortened by providing the protrusion 82 on the pressure receiving member 81. Therefore, when manufacturing the pressure adjustment unit 30, it is possible to more effectively suppress the distal end of the shaft portion 91*d* from coming into contact with the valve seat 42. In addition, according to the fourth embodiment, because the length of the shaft portion 91*d* can be shortened, it is not necessary to increase the length of the first wall 34 along the first direction D1 in order to make the length H1 of the shaft portion 91*d* smaller than the depth H2 of the first chamber 53. Therefore, it is possible to suppress an increase in the size of the pressure adjustment unit 30.

E. Fifth Embodiment

Figure 13:
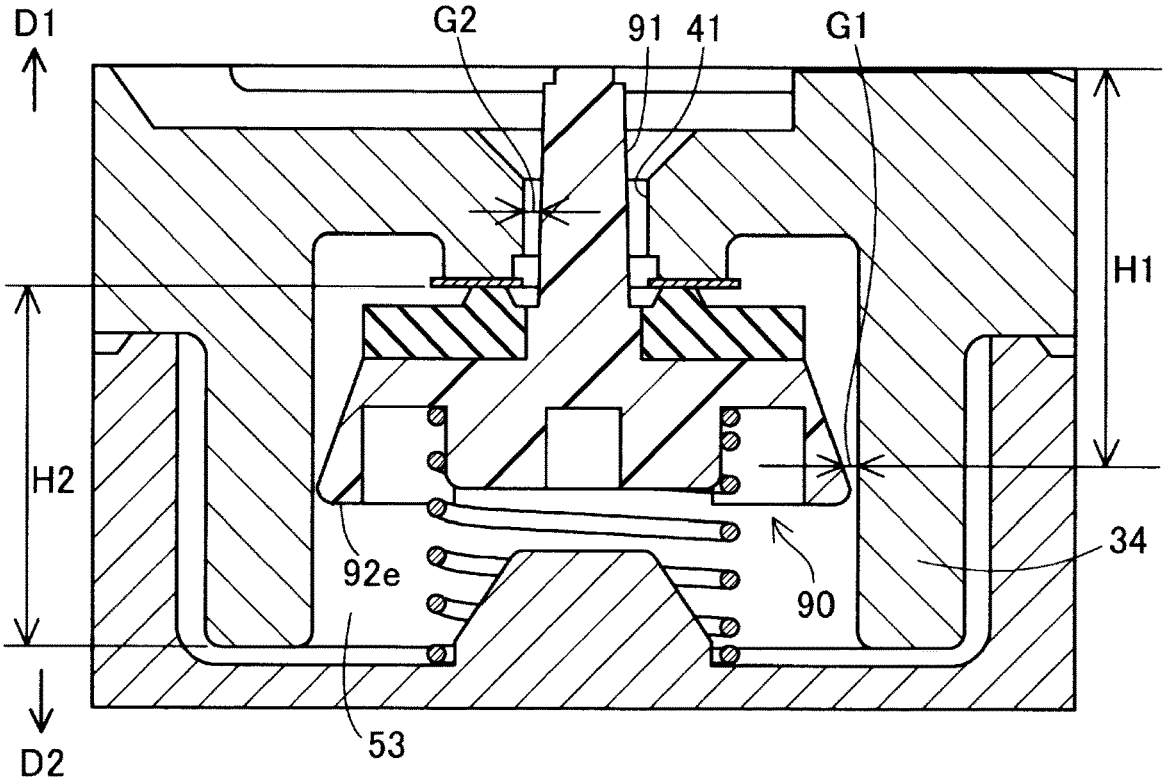
FIG. 13 is a diagram illustrating a shape of a valve body according to a fifth embodiment.

FIG. 13 is a diagram illustrating a shape of the valve body 90 according to a fifth embodiment. The shape of the base end portion 92 of the valve body 90 in the first embodiment and the shape of a base end portion 92*e* of the valve body 90 in the fifth embodiment are different. Specifically, in the fifth embodiment, the base end portion 92*e* is formed so that an end portion thereof in the first direction D1 has a smaller diameter than an end portion thereof in the second direction D2. That is, in the fifth embodiment, the shape of the base end portion 92*e* is tapered in the first direction D1.

In this embodiment, among the portions of the base end portion 92*e* that satisfy the relationship that the gap G2 between the shaft portion 91 and the through hole 41 is larger than the distance G1 from the outer periphery surface of the base end portion 92*e* to the inner periphery surface of the first wall 34, the distance H1 along the first direction D1 from the portion of the base end portion 92*e* closest to the shaft portion 91 to the distal end of the shaft portion 91 is smaller than the depth H2 of the first chamber 53.

According to the fifth embodiment described above, because the base end portion 92*e* is formed in such a manner that a diameter of an end portion thereof in the first direction D1 is smaller than a diameter of an end portion thereof in the second direction D2, when manufacturing the pressure adjustment unit 30, the base end portion 92*e* can be easily inserted into the first wall 34.

F. Sixth Embodiment

Figure 14:
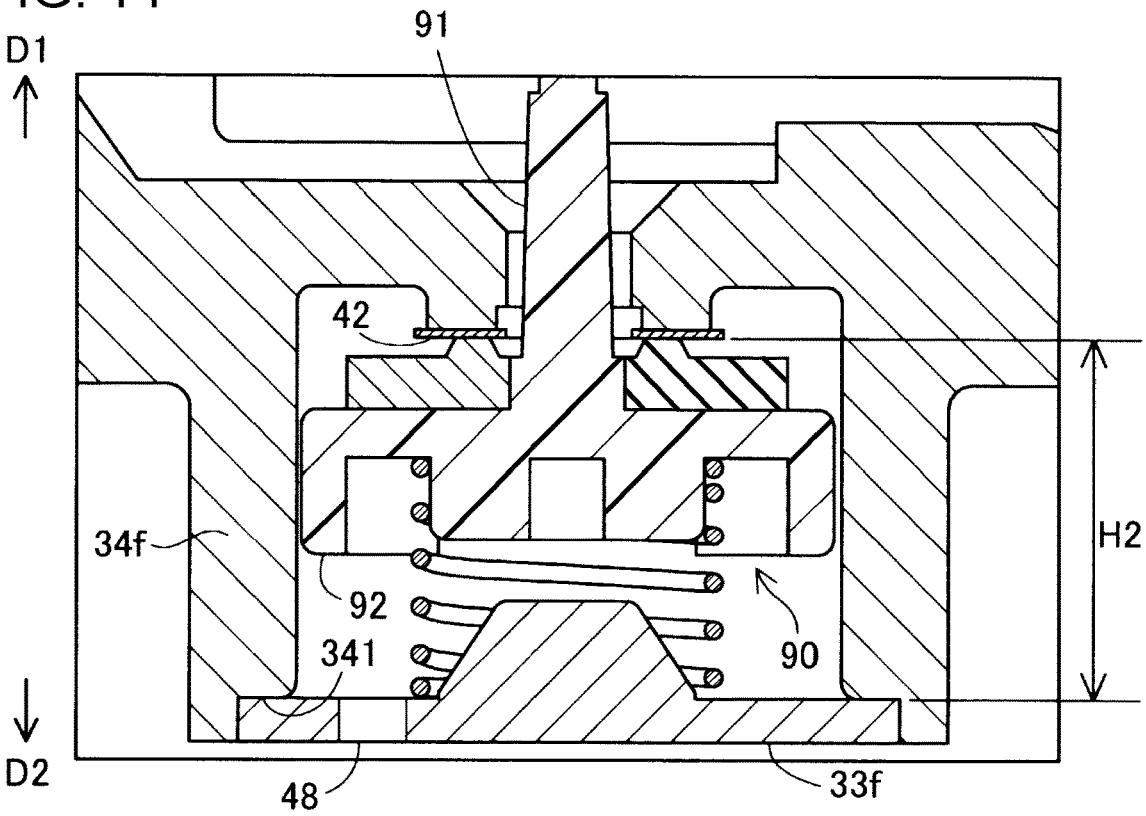
FIG. 14 is a diagram illustrating a configuration of a first wall according to a sixth embodiment.

FIG. 14 is a diagram illustrating the configuration of a first wall 34*f* in a sixth embodiment. The structure of the first wall 34 in the first embodiment and the structure of the first wall 34*f* in the sixth embodiment are different. Specifically, in the first embodiment, the second-direction-D2 end portion of the first wall 34 has a flat shape, whereas in the sixth embodiment, a step is provided at a second-direction-D2 end portion of the first wall 34*f*. The first wall 34*f* is inside the surface of the second-direction-D2 end portion of the first wall 34*f*, and has a stepped surface 341 located on the first-direction-D1 side of the surface of the second-direction-D2 end portion of the first wall 34*f*. That is, a step is formed between the surface of the second-direction-D2 end portion of the first wall 34*f* and the stepped surface 341 in such a manner that the depth of the inner periphery surface of the first wall 34*f* becomes smaller. Then, a sealing member 33*f* is disposed on the stepped surface 341. In such a configuration, a "distance H2, in the first direction D1, between the valve seat 42 and the second-direction-D2-side end portion of the first wall 34*f*" is the distance H2, in the first direction D1, between the valve seat 42 and the stepped surface 341.

G. Other Embodiments (G-1) In the above embodiments, the inflow port 48 that enables flow of ink into the first chamber 53, when viewed in the second direction D2, is provided at a position overlapping the first wall 34. On the other hand, the inflow port 48 may be provided at another position. For example, the inflow port 48 may be provided along the radial direction of the first wall 34 so as to penetrate the first wall 34, and may be provided between the first projecting portion 36 formed on the sealing member 33 and the first wall 34. When the inflow port 48 is provided at such a position, the groove portion 35 need not be formed on the first wall 34.

(G-2) In the above embodiments, when the base end portion 92 and the first wall 34 are viewed in the second direction D2, the continuous length L1 of the positioning regions 95 is larger than the continuous length L2 of the bottom surface 351 of the groove portion 35. On the other hand, the continuous length L1 of the positioning regions 95 may be smaller than the continuous length L2 of the bottom surface 351 of the groove portion 35. In this case, as in the above embodiment, the thickness of the base end portion 92 along the first direction D1 is preferably larger than the depth of the groove portion 35.

(G-3) In the above embodiments, as illustrated in FIG. 5, the clearances 39 are formed between the outer periphery portion of the base end portion 92 and the first wall 34, and ink flows through the clearances 39. On the other hand, the clearances 39 need not be provided on the outer periphery portion of the base end portion 92. That is, the outer periphery portion of the base end portion 92 may be formed as the sliding contact portion 38. In this case, it is possible to form a flow path that enables the flow of ink by providing a through hole along the first direction D1 on the inside of the outer periphery of the base end portion 92 and on the outside of the portion where the elastic member 93 and the valve seat 42 come into contact with each other.

(G-4) In the above embodiment, the first chamber 53 is sealed by the sealing member 33. On the other hand, the first chamber 53 may be sealed with a film similarly to the second chamber 54.

(G-5) In the above embodiment, the valve seat 42 is formed of a metal. On the other hand, the valve seat 42 may be formed of the same material as the partition wall 40. In addition, the valve seat 42 may be integrated with the partition wall 40. That is, a portion of the partition wall 40 may also function as the valve seat 42.

(G-6) In the above embodiments, the partition wall 40, when viewed in the first direction D1, has the recessed portion 43 that is annular and that is recessed in the first direction D1 from the portion outside the portion where the valve seat 42 is provided. On the other hand, the partition wall 40 does not have to be provided with the recessed portion 43 such as the one described above. When the partition wall 40 does not include the recessed portion 43, the valve seat 42 may exist in the same plane as the lower surface of the partition wall 40.

H. Other Aspects

The present disclosure is not limited to the above-described embodiments, and can be realized in various configurations without departing from the gist thereof. For example, the technical features of the embodiments corresponding to the technical features in each of the aspects described below may be used to solve some or all of the above-mentioned problems, and may be replaced or combined as necessary in order to accomplish some or all of the effects of the disclosure. In addition, unless technical features are described as essential in this specification, they can be deleted as appropriate.

(1) According to a first aspect of the present disclosure, there is provided a pressure adjustment unit that has a first chamber, a second chamber, and a through hole which extends in a first direction from the first chamber to the second chamber and through which the first chamber communicates with the second chamber, the first chamber, the second chamber, and the through hole forming a flow path supplying a liquid to a nozzle that ejects the liquid. The pressure adjustment unit includes a valve body that has a base end portion housed in the first chamber, a shaft portion protruding in the first direction from the base end portion, and an elastic member provided on a first direction side of the base end portion; a casing that has a partition wall which partitions the first chamber and the second chamber and in which the through hole into which the shaft portion is inserted is formed, and that has a first wall which is annular and which protrudes in a second direction opposite to the first direction so as to define the first chamber, in which, on a first chamber side of the partition wall, a valve seat, which is annular, is provided around the through hole so as to block the flow path by coming into contact with the elastic member, an outer diameter of the base end portion is larger than an outer diameter of the shaft portion, an outer periphery of the base end portion has a positioning region in which a distance between an outer periphery surface of the base end portion and an inner periphery surface of the first wall is shorter than a distance between the shaft portion and an inner periphery surface of the through hole, and a distance in the first direction between a first-direction-side end portion of the positioning region and a first-direction-side distal end of the shaft portion is shorter than a distance in the first direction between the valve seat and a second-direction-side end portion of the first wall.

According to this aspect, since the valve body is positioned by the base end portion and the first wall before the shaft portion is inserted into the through hole, it is possible to suppress the distal end of the shaft portion from coming into contact with the valve seat and being scraped.

(2) In the above aspect, the elastic member, when viewed in the second direction, may be provided inside the outer periphery of the base end portion and outside the shaft portion. In this case, the size of the elastic member can be reduced. Furthermore, since the outer periphery of the base end portion is not covered with the elastic member, the positioning accuracy of the base end portion with respect to the first chamber can be improved. If the outer periphery of the base end portion is covered with an elastic member, because the elastic member comes into contact with the inner periphery surface of the first wall and bends, the positioning accuracy of the base end portion with respect to the first chamber is lowered.

(3) In the above aspect, the partition wall and the shaft portion may be formed of a resin, and the valve seat may be formed of a metal. In this case, since the valve seat is formed of a metal, it is difficult for liquid components to accumulate on the valve seat. In addition, in this case, although the shaft portion is formed of a resin, because the valve body is positioned by the base end portion and the first wall before the shaft portion is inserted into the through hole, it is possible to suppress the distal end of the shaft portion from coming into contact with the valve seat and being scraped.

(4) In the above aspect, the pressure adjustment unit may further include a sealing member that defines the first chamber and that is provided with an inflow port that enables flow of the liquid into the first chamber, in which a groove portion recessed in the first direction may be provided in a portion of the first wall at a portion where the inflow port opens to the first chamber, and the groove portion may communicate with the first chamber. In this case, it is possible to reduce the pressure loss when the liquid flows from the inflow port to the first chamber.

(5) In the above aspect, the sealing member may cover the first wall from an outer periphery side, and a bottom surface of the groove portion may be located on a first direction side of a fixing surface at which the sealing member is fixed to the casing. In this case, the air bubble discharge property can be improved.

(6) In the above aspect, a continuous length of the positioning region along the outer periphery of the base end portion may be larger than a continuous length of a bottom surface of the groove portion along the inner periphery surface of the first wall. In this case, it is possible to suppress the base end portion of the valve body from being accidentally fitted into the groove portion.

(7) In the above aspect, the base end portion may have a projecting portion that protrudes in the first direction from a surface on which the shaft portion is provided on an outer periphery portion of the base end portion, and the projecting portion may be a portion of the positioning region. In this case, by extending the first wall along the second direction, it is possible to suppress the pressure adjustment unit from becoming large.

(8) In the above aspect, the partition wall, when viewed in the first direction, may have a recessed portion that is annular and that is recessed in the first direction from a portion outside a portion where the valve seat is provided, when viewed in the first direction, the recessed portion and the projecting portion may overlap, and the projecting portion may protrude in the first direction further than a contact surface between the valve seat and the elastic member in a state where the valve body is in contact with the valve seat. In this case, it is possible to more effectively suppress an increase in the size of the pressure adjustment unit.

(9) In a second aspect of the present disclosure, a liquid ejecting head includes the pressure adjustment unit of the first aspect, and the nozzle that ejects the liquid.

(10) In a third aspect of the present disclosure, a liquid ejecting apparatus includes the pressure adjustment unit of the first aspect, the nozzle that ejects the liquid, and a transport portion that transports a medium.

What is claimed is:

1. A pressure adjustment unit that has a first chamber, a second chamber, and a through hole which extends in a first direction from the first chamber to the second chamber and through which the first chamber communicates with the second chamber, the first chamber, the second chamber, and the through hole forming a flow path supplying a liquid to a nozzle that configures to eject the liquid, the pressure adjustment unit comprising:

a valve body that has a base end portion housed in the first chamber, a shaft portion protruding in the first direction from the base end portion, and an elastic member provided on a first direction side of the base end portion; and a casing that has a partition wall which partitions the first chamber and the second chamber and in which the through hole into which the shaft portion is inserted is formed, and that has a first wall which is annular and which protrudes in a second direction opposite to the first direction so as to define the first chamber, wherein on a first chamber side of the partition wall, a valve seat, which is annular, is provided around the through hole so as to block the flow path by coming into contact with the elastic member, an outer diameter of the base end portion is larger than an outer diameter of the shaft portion, an outer periphery of the base end portion has a positioning region in which a distance between an outer periphery surface of the base end portion and an inner periphery surface of the first wall is shorter than a distance between the shaft portion and an inner periphery surface of the through hole, and a distance in the first direction between a first-direction-side end portion of the positioning region and a first-direction-side distal end of the shaft portion is shorter than a distance in the first direction between the valve seat and a second-direction-side end portion of the first wall.

2. The pressure adjustment unit according to claim 1, wherein the elastic member, when viewed in the second direction, is provided inside the outer periphery of the base end portion and outside the shaft portion.

3. A liquid ejecting head comprising:

the pressure adjustment unit according to claim 2; and the nozzle configured to eject the liquid.

4. A liquid ejecting apparatus comprising:

the pressure adjustment unit according to claim 2;

the nozzle configured to eject the liquid; and a transport portion that transports a medium.

5. The pressure adjustment unit according to claim 1, wherein the partition wall and the shaft portion are formed of a resin, and the valve seat is formed of a metal.

6. A liquid ejecting head comprising:

the pressure adjustment unit according to claim 5; and the nozzle configured to eject the liquid.

7. A liquid ejecting apparatus comprising:

the pressure adjustment unit according to claim 5;

the nozzle configured to eject the liquid; and a transport portion that transports a medium.

8. The pressure adjustment unit according to claim 1, further comprising:

a sealing member that defines the first chamber and that is provided with an inflow port for flowing the liquid into the first chamber, wherein a groove portion recessed in the first direction is provided in the first wall at a portion facing the inflow port, and the groove portion communicates with the first chamber.

9. The pressure adjustment unit according to claim 8, wherein the sealing member covers the first wall from an outer periphery side, and a bottom surface of the groove portion is located in the first direction with respect to a fixing surface at which the sealing member is fixed to the casing.

10. The pressure adjustment unit according to claim 8, wherein a continuous length of the positioning region along the outer periphery of the base end portion is larger than a continuous length of a bottom surface of the groove portion along the inner periphery surface of the first wall.

11. The pressure adjustment unit according to claim 1, wherein the base end portion has a projecting portion that protrudes in the first direction from a surface on which the shaft portion is provided on an outer periphery portion of the base end portion, and the projecting portion is a portion of the positioning region.

12. The pressure adjustment unit according to claim 11, wherein the partition wall, when viewed in the first direction, has a recessed portion that is annular and that is recessed in the first direction from a portion outside a portion where the valve seat is provided, when viewed in the first direction, the recessed portion and the projecting portion overlap, and the projecting portion protrudes in the first direction further than a contact surface between the valve seat and the elastic member in a state where the valve body is in contact with the valve seat.

13. A liquid ejecting head comprising:

the pressure adjustment unit according to claim 1; and the nozzle configured to eject the liquid.

14. A liquid ejecting apparatus comprising:

the pressure adjustment unit according to claim 1;

the nozzle configured to eject the liquid; and a transport portion that transports a medium.

* * * * *